US006938282B2

(12) United States Patent
Yamamoto

(10) Patent No.: US 6,938,282 B2
(45) Date of Patent: Sep. 6, 2005

(54) ARTICLE WASHING APPARATUS

(75) Inventor: Seiji Yamamoto, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/453,521

(22) Filed: Jun. 4, 2003

(65) Prior Publication Data

US 2004/0031095 A1 Feb. 19, 2004

(30) Foreign Application Priority Data

Jun. 4, 2002 (JP) ..... 2002-162325
Mar. 12, 2003 (JP) ..... 2003-066712

(51) Int. Cl.[7] ..... A47K 1/04
(52) U.S. Cl. ..... 4/619
(58) Field of Search ..... 4/619; 134/182, 134/198

(56) References Cited

U.S. PATENT DOCUMENTS 2,310,617 A * 2/1943 Conner ..... 4/624
2,504,271 A * 4/1950 Maguire ..... 4/631
4,969,220 A * 11/1990 Raigneau ..... 4/619
5,670,945 A * 9/1997 Applonie ..... 340/573.1
2002/0050006 A1 * 5/2002 Saraya ..... 4/619

FOREIGN PATENT DOCUMENTS

JP 56-46039 A 4/1981
JP 5-79283 A 3/1993

* cited by examiner

*Primary Examiner*—Charles E. Phillips
(74) *Attorney, Agent, or Firm*—Birch, Stewart, Kolasch & Birch, LLP

(57) ABSTRACT

A tableware washing apparatus is adapted to allow garbage deposited to tableware to be washed off by washing water injected toward the inside of a shower sink, and the garbage dropped into the inside of the shower sink to be washed out with the washing water. A cross-sectional shape of the shower sink includes a bottom wall having a large curvature, a first sidewall rising substantially vertically from one of opposite ends of the bottom wall, and a second sidewall rising from the other end of the bottom wall and having a curvature smaller than that of the bottom wall. A sectional area of a flow path at the bottom wall is small, as compared with a shower sink having a quadrilateral section or a circular section. Therefore, even if the flow rate of the washing water is reduced to save water, the flow speed of the washing water flowing on the bottom wall can be raised to effectively wash out the garbage.

20 Claims, 4 Drawing Sheets

2
29
30a
35
18
16
11
15
30b
31
32
R
33
23
21
22
3
3
17
13
19
12
14
18
35
2

ARTICLE WASHING APPARATUS

BACKGROUND OF THE INVENTION

1. Field of the Invention

The present invention relates to an article washing apparatus adapted to allow waste deposited to an article to be washed off by washing water injected toward the inside of a shower sink, and the waste dropped into the inside of the shower sink to be washed out with the washing water.

2. Description of the Related Art

A shower sink for washing off garbage deposited to tableware is used by a person having finished a meal in a dining room where a large number of persons take their meals. A conventional shower sink is formed into a quadrilateral-tub-shape in section and adapted to allow garbage deposited to tableware to be washed off by washing water injected from a nozzle mounted at an upper portion of a front sidewall of the shower sink, so that the garbage is washed out along with the washing water flowing on a bottom wall of the shower sink.

An article washing apparatus is known from Japanese Patent Application Laid-open No. 56-46039 and No. 5-79283, which is designed so that the flow speed of water is raised by using a so-called egg-shaped pipe having an egg-shaped section as a sewer pipe to prevent the accumulation of a foreign matter.

In the conventional apparatus, because a shower sink is quadrilateral in section, the flow speed of washing water flowing on a bottom wall is disadvantageously difficult to rise, and unless a large amount of washing water is fed, garbage is accumulated on the bottom wall of the shower sink. If the garbage is accumulated on the bottom wall of the shower sink as described above, a discomfort is given to a user. In order to prevent the accumulation of the garbage, it is disadvantageously necessary to feed a large amount of washing water, resulting in a poor economy.

SUMMARY OF THE INVENTION

The present invention has been accomplished with the above circumstance in view, and it is an object of the present invention to prevent the accumulation of waste which has been deposited to an article to be washed, while minimizing the consumption of washing water in the shower sink.

To achieve the above object, according to a first feature of the present invention, there is provided an article washing apparatus adapted to allow waste deposited to an article to be washed off by washing water injected toward the inside of a shower sink, and the waste dropped into the inside of the shower sink to be washed out with the washing water, wherein a cross-sectional shape of the shower sink includes a bottom wall having a large curvature, a first sidewall rising substantially vertically from one of opposite ends of the bottom wall, and a second sidewall rising from the other end of the bottom wall and having a curvature smaller than that of the bottom wall.

With the above arrangement, the cross-sectional shape of the shower sink includes the bottom wall having the large curvature, the first sidewall rising substantially vertically from one of opposite ends of the bottom wall, and the second sidewall rising from the other end of the bottom wall and having the curvature smaller than that of the bottom wall. Therefore, a sectional area of a flow path at the bottom wall is small, as compared with a shower sink having a quadrilateral section or a circular section. As a result, even if the flow rate of the washing water is reduced to save water, the flow speed of the washing water flowing on the bottom wall can be raised to effectively wash out the waste.

According to a second feature of the present invention, in addition to the first feature, a nozzle for injecting the washing water is provided at an upper portion of the first sidewall, and a flat reflecting plate facing obliquely downwards is disposed at an upper portion of the second sidewall, to which the washing water injected from the nozzle is directed.

With the above arrangement, the flat reflecting plate facing obliquely downwards is disposed at the upper portion of the second sidewall, to which the washing water injected from the nozzle is directed. Therefore, even if the washing water is strongly injected to enhance the article-washing effect, the washing water colliding with the reflecting plate can be deflected downwards and prevented from rebounding upwards.

According to a third feature of the present invention, in addition to the second feature, a water reservoir is provided behind the reflecting plate so that the washing water is supplied from the water reservoir to the second sidewall.

With the above arrangement, the washing water is supplied from the water reservoir provided behind the reflecting plate to the second sidewall. Therefore, the second sidewall cannot be dried, and the waste is dropped reliably to the bottom wall of the shower sink without being deposited to the second sidewall, whereby the second sidewall can be kept clean.

According to a fourth feature of the present invention, the water reservoir has a slit provided in its bottom for supplying the washing water to the second sidewall.

With the above arrangement, the washing water is supplied from the slit provided in the bottom of the water reservoir to the second sidewall and hence, the flow rate of the washing water can be adjusted by the slit, whereby a necessary and sufficient amount of the washing water can be supplied, and the consumption of washing water can be minimized.

According to a fifth feature of the present invention, in addition to any of the first to fourth features, the article is tableware, and the waste is garbage.

With the above arrangement, the article is the tableware, and the waste is the garbage and hence, the garbage deposited to the tableware can be washed off.

According to a sixth feature of the present invention, in addition to the fifth feature, a person holding the tableware stands on a side of the first sidewall of the shower sink.

With the above arrangement, the person holding the tableware stands on the side of the first sidewall of the shower sink, and hence the person can cleanly wash off the garbage deposited to the tableware by the washing water injected from the nozzle, while watching the garbage and confirming the state of the tableware from which the garbage is removed. Further, because the bottom wall on which the garbage flows is located immediately below the first sidewall, the garbage is difficult to see, leading to a reduction in discomfort.

According to a seventh feature of the present invention, in addition to the sixth feature, the washing water is injected when it is detected that the person holding the tableware has approached the first sidewall of the shower sink.

With the above arrangement, the washing water is injected when it is detected that the person holding the tableware has approached the first sidewall of the shower sink. Therefore, the wasteful injection of the washing water can be prevented to further save water.

Tableware 34 in an embodiment corresponds to the article in the present invention, and garbage in the embodiment corresponds to the waste in the present invention.

DESCRIPTION OF THE PREFERRED EMBODIMENT

Figure 1:
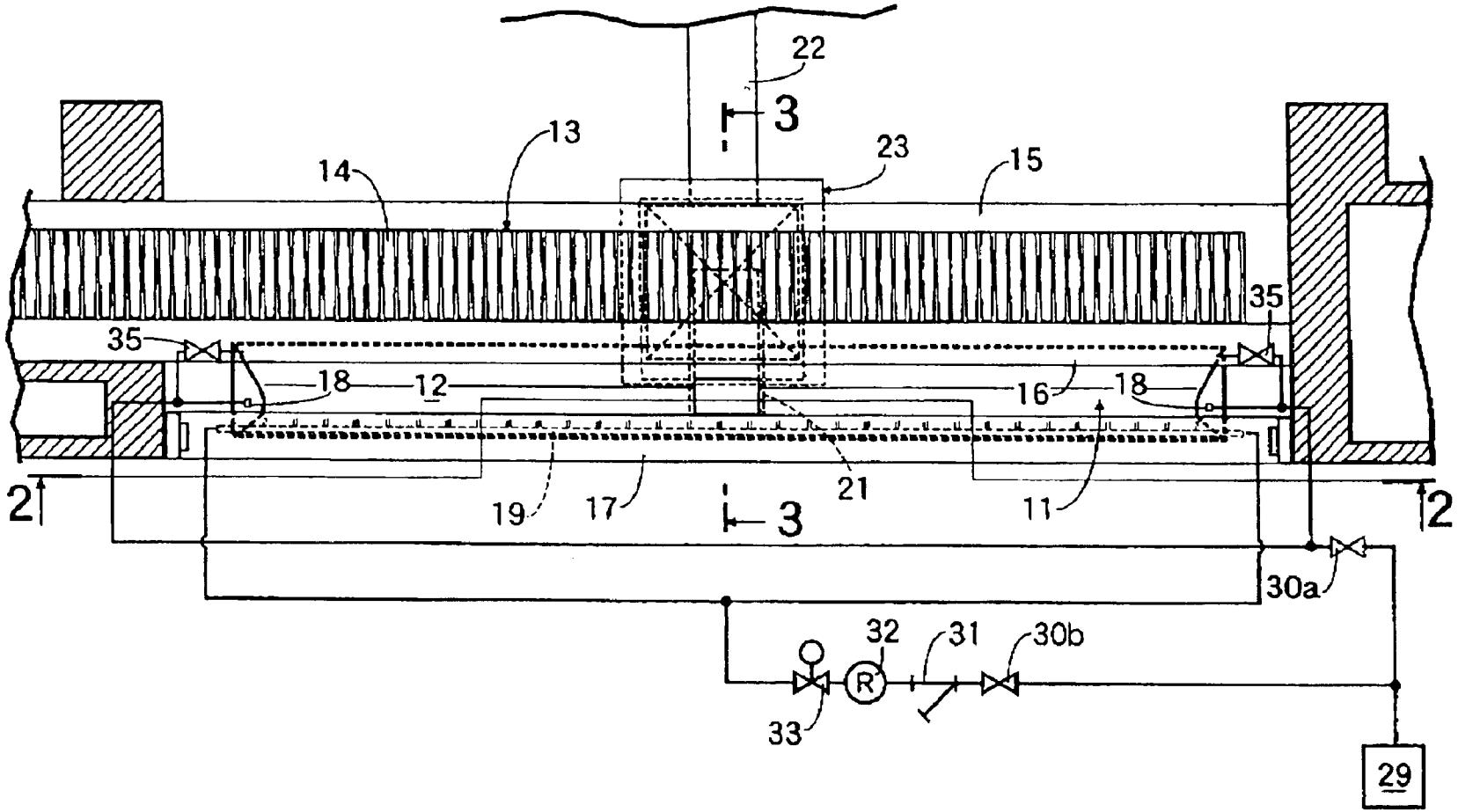
FIG. 1 is a plan view of the entire arrangement of tableware washing apparatus.
Figure 2:
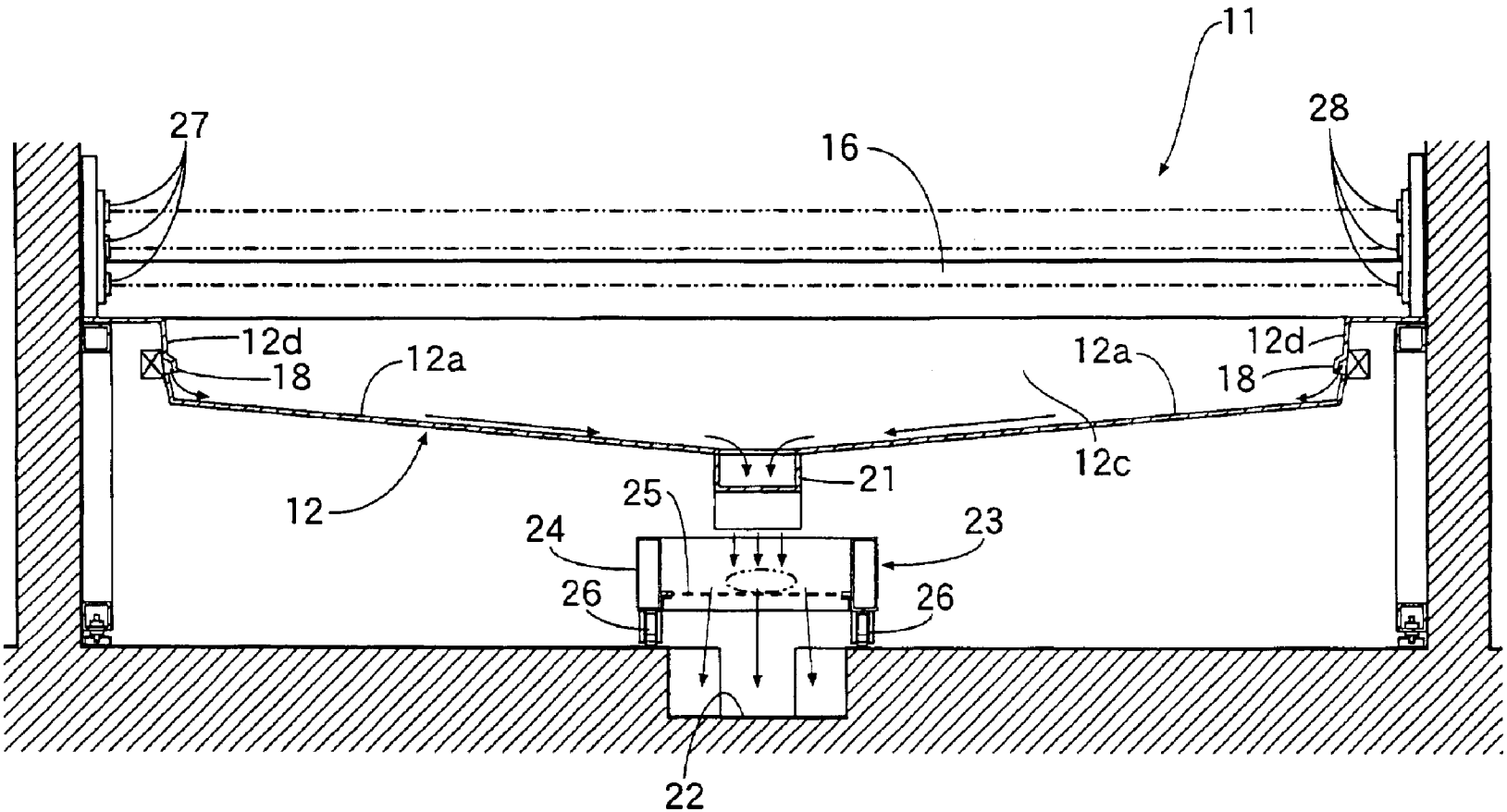
FIG. 2 is a sectional view taken along a line 2—2 in FIG. 1.
Figure 3:
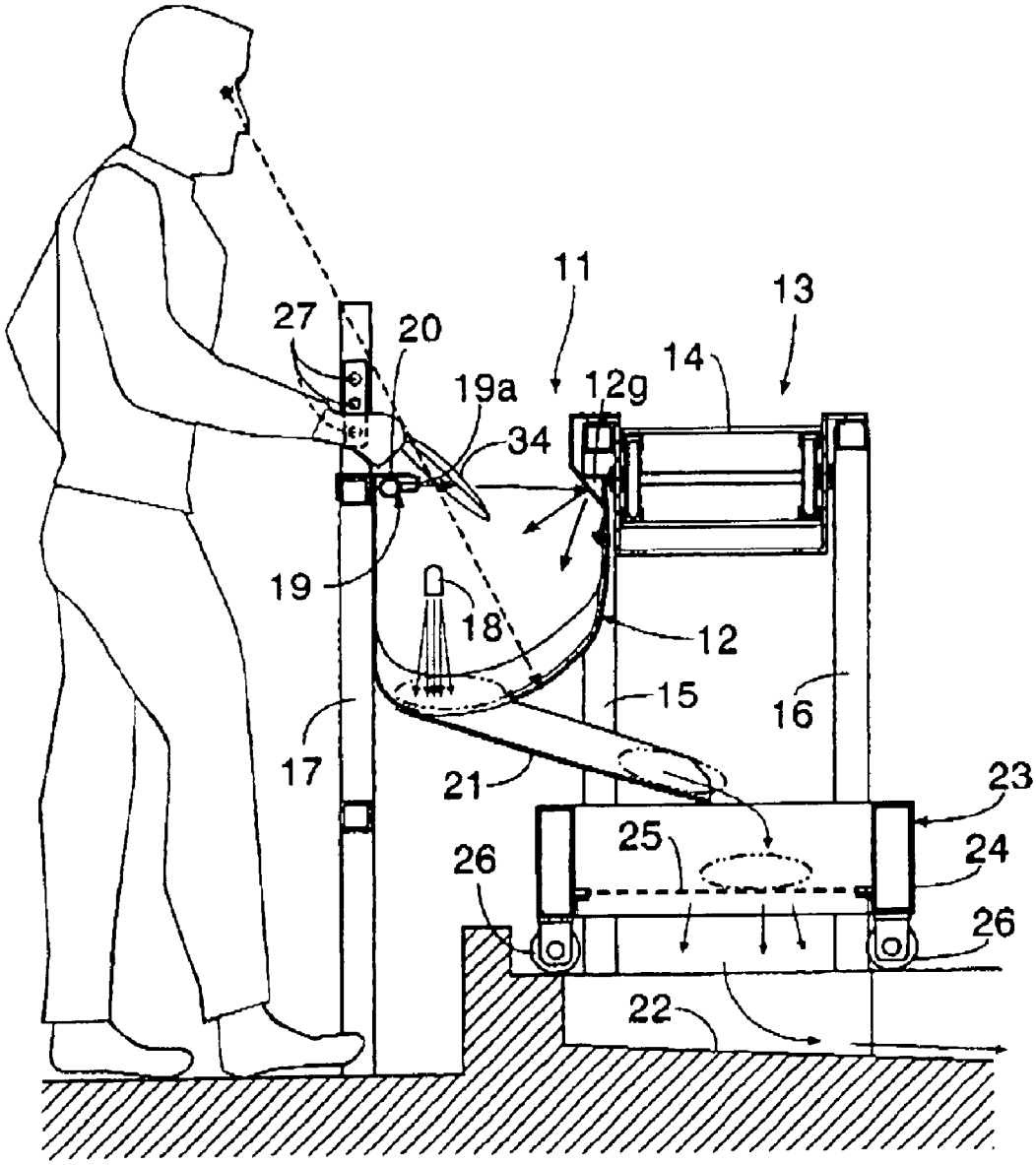
FIG. 3 is an enlarged sectional view taken along a line 3—3 in FIG. 1.

An embodiment of the present invention will now be described with reference to the accompanying drawings.

As shown in FIGS. 1 to 4, tableware washing apparatus 11 for washing off garbage deposited on tableware by a person having finished a meal in a dining room, includes a substantially tub-shaped-shower sink 12 having an upper surface opened, and a slat conveyer 13 for transporting the tableware is disposed in parallel beyond the tableware washing apparatus 11. The slat conveyer 13 has an endless slats 14 rotatably disposed at upper ends of frames 15 and 16 to form tableware transporting surface. The shower sink 12 of the tableware washing apparatus 11 is supported between one of the frames 15 and a frame 17 disposed in front of the frame 15.

Figure 4:
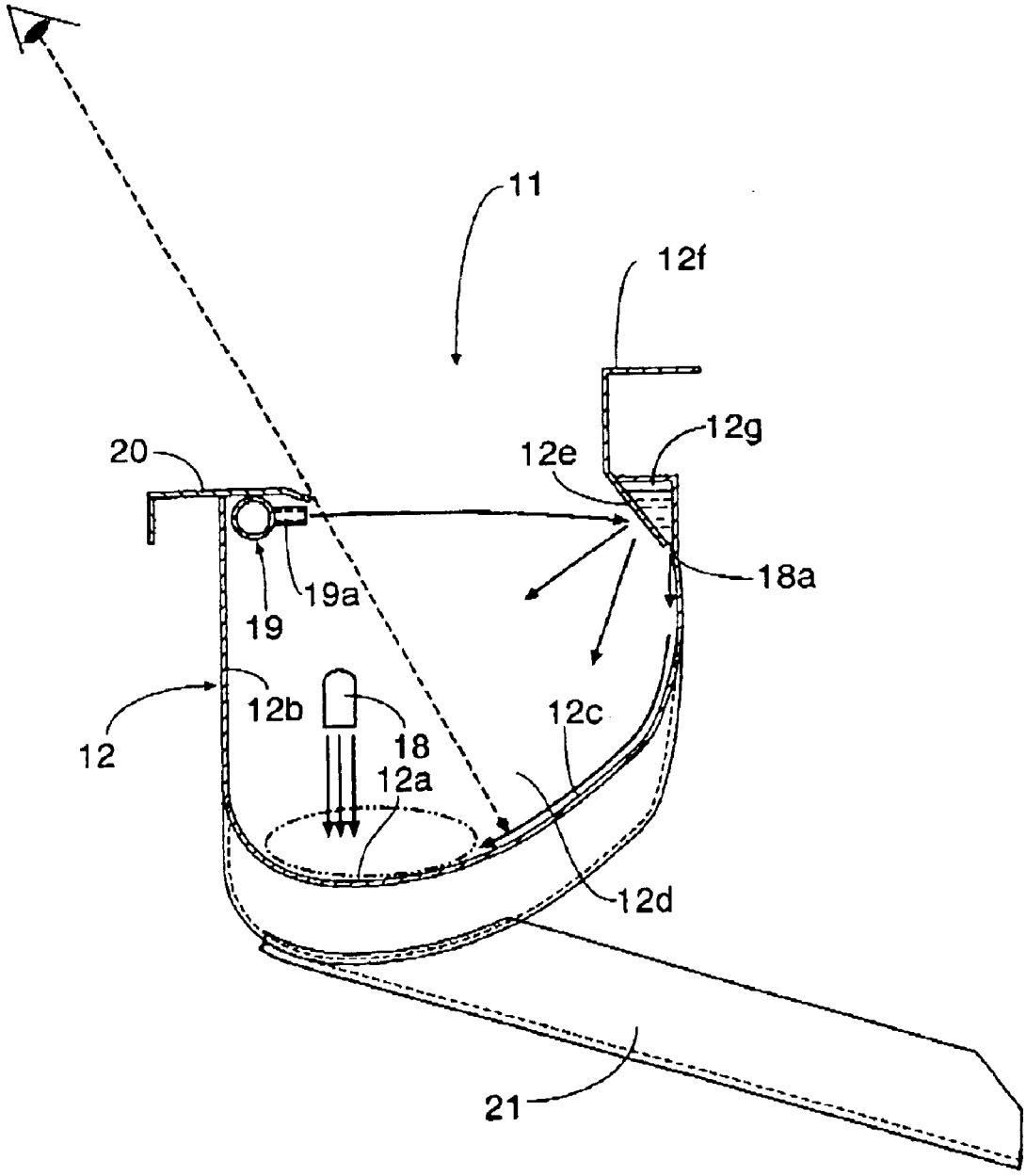
FIG. 4 is an enlarged view of essential portions of FIG. 3.

As can be seen from FIG. 4, the shower sink 12 is formed by curving a metal plate and has a particular cross-sectional shape. More specifically, the cross-section of the shower sink 12 includes a bottom wall 12*a* having a smaller radius of curvature (a larger curvature), a first flat sidewall 12*b* vertically rising from the closer side of the bottom wall 12*a*, and a second curved sidewall 12*c* extending upwards from the far side of the bottom wall 12*a*. The second sidewall 12*c* has a radius of curvature larger than that of the bottom 12*a* (a curvature smaller than that of the bottom wall 12*a*). Therefore, the bottom wall 12*a* lies toward the first sidewall 12*b* from the widthwise central portion of the shower sink 12, and is located substantially immediately below the vertical first sidewall 12*b*.

The shower sink 12 has a depth deeper at its lengthwise central portion and shallower at its opposite ends, and the bottom wall 12*a* is inclined slightly from its opposite ends toward its central portion. Therefore, the cross-sectional shape of the shower sink 12 is deformed slightly in a lengthwise direction, but is basically of the same shape and comprised of the bottom wall 12*a*, the first sidewall 12*b* and the second sidewall 12*c* in any position.

The opposite ends of the shower sink 12 are closed by end walls 12*d*, 12*d*, and water-pouring ports 18, 18 are provided therein by cutting and raising the end walls. A water supply pipe 19 is disposed to extend along an inner surface of an upper portion of the first sidewall 12*b* of the shower sink 12, and covered invisibly with a cover plate 20 connected horizontally to an upper end of the first sidewall 12*b*. The water supply pipe 19 is provided with a large number of nozzles 19*a* for injecting washing water in a substantially horizontal direction. A reflecting plate 12*e* is disposed at an upper end of the second sidewall 12*c* to face obliquely downwards. A connecting plate 12*f* leading to the frame 14 of the slat conveyer 13 is disposed to cover an upper portion of the reflecting plate 12*e*.

A water reservoir 12*g* circular in section is provided behind the reflecting plate 12*e* of the shower sink 12 to extend along the upper end of the second sidewall 12*c*. A slit 18*a* having a small width (e.g., 1 mm or less) is formed in a lower end of the water reservoir 12*g*. A given amount of washing water is always stored in the water reservoir 12*g*, so that the washing water is throttled by the slit 18*a* into a film shape and supplied to the upper end of the second sidewall 12*c*.

A drainage tub 21 is connected at its upper end to the deepest central portion of the shower sink 12 and extends toward below the slat conveyer 13, so that its lower end faces above a drainage groove 22 formed in a floor surface below the slat conveyer 13. A carriage 23 disposed between a lower end of the drainage tub 21 and the drainage groove 22 includes a frame 24, a net 25 spread on a lower surface of the frame 24, and casters 26 mounted at four corners of the frame 24.

Projectors 27 and receptors 28 of a photoelectric switch are mounted in front of the opposite ends of the shower sink 12. It is detected that a person stands in front of the shower sink 12, when light rays emitted from the projectors 27 are blocked by the person and do not reach the receptors 28. The washing water from a water supply source 29 is constantly supplied from the water pouring ports 18, 18 at the opposite ends of the shower sink 12 through a manual on-off valve 30*a*. Portions of the washing water diverted at a location in front of the water-pouring ports 18, 18 are supplied to opposite ends of the water reservoir 12*g* through manual on-off valves 35, 35. The water supply source 29 is connected to the water supply pipe 19 through a manual on-off valve 30*b*, a strainer 31, a pressure-reducing valve 32 and a solenoid valve 33 which is operated by a signal from the photoelectric switch.

The operation of the embodiment of the present invention having the above-described arrangement will be described below.

When a person having finished a meal stands in front of the shower sink 12 with garbage-deposited tableware 34 in his hand, the photoelectric switch is operated to inject the washing water from the nozzles 19*a* of the water supply pipe 19. When the tableware from which the garbage has been washed off by the washing water is put on the slat conveyer 13, the tableware 34 is transported to tableware washing tank located at a subsequent stage. The washing water injected from the nozzles 19*a* is diffused in a shower shape and hence, the washing water can be forced against a wider area of the tableware, whereby the consumption of washing water can be reduced while providing an enhancement in washing effect. The garbage dropped to the bottom wall 12*a* of the shower sink 12 is caused to flow toward the lowest central portion of the shower sink 12 by the washing water supplied from the water-pouring ports 18, the washing water supplied from the slit 18*a* in the water reservoir 12*g* and the washing water supplied from the nozzles 19*a*, and is then dropped onto the carriage via the drainage tub 21. The garbage contained in the washing water is caught on the net 25 in the carriage 23, and only the washing water is discharged into the drainage groove 22. The garbage caught on the net 25 is transported along with the carriage 23 and collectively subjected to disposal.

The washing water flowing out of the slit 18*a* in the water reservoir 12*g* flows downwards along the second sidewall 12*c* of the shower sink 12 to constantly keep the second sidewall 12*c* wet. Therefore, the garbage is forced to flow immediately to the bottom wall 12*a* of the shower sink 12 without being caked on the second sidewall 12*c* by the washing water flowing along the second sidewall 12*c*. Thus, the second sidewall 12*c* liable to be most conspicuous to a person standing in front of the shower sink 12 can be always kept clean, so that a discomfort can be prevented from being given to the person. Moreover, the washing water stored in the water reservoir 12*g* is supplied in a necessary and sufficient amount through the narrow slit 18*a*, and hence the consumption of the washing water can be minimized. A given amount of the washing water can be always maintained within the water reservoir 12*g* by adjusting the opening degrees of the manual on-off valves 35, 35.

The washing water injected from the nozzles 19*a* collides with the reflecting plate 12*e* of the shower sink 12, but because the reflecting plate 12*e* is disposed to face obliquely downwards, even if the speed of injected washing water is increased to enhance the washing effect, the washing water is reflected downwards on the reflecting plate 12*e* and prevented from being splashed upwards.

Since the sectional shape of the shower sink 12 includes the bottom wall 13*a* having the large curvature, the sectional area of the bottom wall is small, as compared with a shower sink having a quadrilateral section or a circular section. Even if the flow rate of the washing water is reduced to save water, the flow speed of the washing water flowing on the bottom wall 12*a* can be raised to effectively wash out the garbage. The first sidewall 12*b* on this side of the shower sink 12 is substantially vertical, and hence it is difficult for a person standing on this side of the shower sink 12 to see the garbage flowing on the bottom wall 12*a*, whereby the discomfort can be reduced. The cover plate 20 covering the water supply pipe 19 also contributes to a difficulty in seeing the garbage flowing on the bottom wall 12*a*. A portion of the washing water colliding with the reflecting plate 12*e* joins the washing water from the slit 18*a*, and flows down along the second sidewall 12*c*, thereby preventing the garbage from being deposited on the second sidewall 12*c*. The amount of the washing water flowing down along the first sidewall 12*b* is small, but this provides particularly no problem, because the garbage is naturally difficult to deposit on the substantially vertical first sidewall 12*b*.

As described above, the garbage can be effectively washed out, while reducing the flow rate of the washing water by virtue of the sectional shape of the shower sink 12. Also, the injection of the washing water from the nozzles 19*a* is conducted only during washing of the tableware, whereby the required amount of the washing water can be further reduced.

Although the embodiment of the present invention has been described in detail, it will be understood that various modifications in design may be made without departing from the subject matter of the invention.

For example, the tableware 34 has been illustrated as an article to be washed in the embodiment, but the invention according to the first and second features are applicable to any article to be washed other than the tableware 34.

As discussed above, the article washing apparatus according to the present invention is suitable for washing tableware in a dining room or the like where a large number of persons take a meal, and the article washing apparatus can be used for washing any article having waste deposited thereto.

What is claimed is:

1. An article washing apparatus for a shower sink; comprising:

a sink shower including a bottom wall having a large curvature, a first sidewall rising substantially vertically from one of opposite ends of the bottom wall, a second sidewall rising from the other of the opposite ends of the bottom wall and having a curvature smaller than that of the bottom wall, and a flat reflecting plate facing obliquely downward disposed at an upper part of the second side wall; and a nozzle for injecting washing water toward the flat reflecting plate of the shower sink in order to strike waste deposited on an article disposed in a path of the injected washing water, the waste dropping into the inside of the shower sink being washed out with the washing water.

2. The article washing apparatus according to claim 1, wherein the nozzle for injecting the washing water is provided at an upper portion of the first sidewall.

3. The article washing apparatus according to claim 2, wherein a water reservoir is provided behind the reflecting plate so that the washing water is supplied from the water reservoir to the second sidewall.

4. The article washing apparatus according to claim 3, wherein the water reservoir has a slit provided in its bottom for supplying the washing water to the second sidewall.

5. The article washing apparatus according to claim 1, wherein the article is tableware and the waste is garbage.

6. The article washing apparatus according to claim 5, wherein a person holding the tableware stands on a side of the first sidewall of the shower sink.

7. The article washing apparatus according to claim 6, wherein the washing water is injected when it is detected that the person holding the tableware has approached the first sidewall of the shower sink.

8. The article washing apparatus according to claim 1, the shower sink further comprising a third side wall and a fourth side wall extending substantially perpendicular to the first and the second side walls, each of the third and the fourth side walls being provided with water pouring ports.

9. The article washing apparatus according to claim 8, wherein the water pouring ports are disposed lower in the shower sink than the nozzle.

10. The article washing apparatus according to claim 1, further comprising a drainage tub attached a low part of the bottom side wall and extending rearwardly and downwardly under the second side wall.

11. An article washing apparatus adapted to allow waste to be washed off by washing water injected toward the inside of a shower sink, and the waste dropped into the inside of the shower sink to be washed out with the washing water, wherein a cross-sectional shape of the shower sink includes a bottom wall having a large curvature, a first sidewall rising substantially vertically from one of opposite ends of the bottom wall, and a second sidewall rising from the other end of the bottom wall and having a curvature smaller than that of the bottom wall, wherein a nozzle for injecting the washing water is provided at an upper portion of the first sidewall, and a flat reflecting plate facing obliquely downwards is disposed at an upper portion of the second sidewall, to which the washing water injected from the nozzle is directed.

12. The article washing apparatus according to claim 11, wherein the washing water is injected in substantially a horizontal direction toward the flat reflecting plate.

13. The article washing apparatus according to claim 11, wherein a water reservoir is provided behind the reflecting plate so that the washing water is supplied from the water reservoir to the second sidewall.

14. The article washing apparatus according to claim 13, wherein the water reservoir has a slit provided in its bottom for supplying the washing water to the second sidewall.

15. The article washing apparatus according to claim 11, wherein the article is tableware and the waste is garbage.

16. The article washing apparatus according to claim 15, wherein a person holding the tableware stands on a side of the first sidewall of the shower sink.

17. The article washing apparatus according to claim 16, wherein the washing water is injected when it is detected that the person holding the tableware has approached the first sidewall of the shower sink.

18. The article washing apparatus according to claim 11, the shower sink further comprising a third side wall and a fourth side wall extending substantially perpendicular to the first and the second side walls, each of the third and the fourth side walls being provided with water pouring ports.

19. The article washing apparatus according to claim 18, wherein the water pouring ports are disposed lower in the shower sink than the nozzle.

20. The article washing apparatus according to claim 11, further comprising a drainage tub attached a low part of the bottom side wall and extending rearwardly and downwardly under the second side wall.

* * * * *